US010557482B2

(12) United States Patent
Anderson

(10) Patent No.: US 10,557,482 B2
(45) Date of Patent: Feb. 11, 2020

(54) PRESSURE EXCHANGE SYSTEM WITH HYDRAULIC DRIVE SYSTEM

(71) Applicant: Energy Recovery, Inc., San Leandro, CA (US)

(72) Inventor: David Deloyd Anderson, Castro Valley, CA (US)

(73) Assignee: ENERGY RECOVERY, INC., San Leandro, CA (US)

( * ) Notice: Subject to any disclaimer, the term of this patent is extended or adjusted under 35 U.S.C. 154(b) by 327 days.

(21) Appl. No.: 15/347,450

(22) Filed: Nov. 9, 2016

(65) Prior Publication Data

US 2017/0130743 A1 May 11, 2017

Related U.S. Application Data

(60) Provisional application No. 62/253,339, filed on Nov. 10, 2015.

(51) Int. Cl.

| | |
|---|---|
| ***F15B 3/00*** | (2006.01) |
| ***F15B 5/00*** | (2006.01) |
| *E21B 43/26* | (2006.01) |

(52) U.S. Cl.

CPC ..... *F15B 3/00* (2013.01); *F15B 5/00* (2013.01); *E21B 43/26* (2013.01)

(58) Field of Classification Search

CPC ..... F04F 13/00; E21B 43/26; E21B 43/267; F15B 3/00

See application file for complete search history.

(56) References Cited

U.S. PATENT DOCUMENTS

| | | | | |
|---|---|---|---|---|
| 9,920,774 | B2 * | 3/2018 | Ghasripoor | E21B 43/26 |
| 9,945,210 | B2 * | 4/2018 | Theodossiou | E21B 41/00 |
| 2009/0180903 | A1 * | 7/2009 | Martin | F04F 13/00 417/405 |
| 2015/0128597 | A1 * | 5/2015 | Schlak | F03B 13/00 60/719 |
| 2015/0184678 | A1 | 7/2015 | Arluck et al. | |
| 2015/0292310 | A1 * | 10/2015 | Ghasripoor | E21B 43/26 166/250.01 |

OTHER PUBLICATIONS

U.S. Appl. No. 15/240,755, filed Aug. 18, 2016, Ghasripoor et al.
PCT International Search Report & Written Opinion of Application No. PCT/US2016/061440 dated Jan. 30, 2017; 11 pgs.

* cited by examiner

*Primary Examiner* — Dominick L Plakkoottam
(74) *Attorney, Agent, or Firm* — Fletcher Yoder, P.C.

(57) ABSTRACT

A system including a rotary isobaric pressure exchanger (IPX) configured to exchange pressures between a first fluid and a second fluid. The rotary IPX includes a rotor and a shaft coupled the rotor. Additionally, the system includes a hydraulic drive system including a hydraulic drive device coupled to the rotor via the shaft. The hydraulic drive device is configured to receive a hydraulic fluid and to convert hydraulic energy of the hydraulic fluid into mechanical energy to rotate the rotor at a rotational speed that is based on a flow rate of the hydraulic fluid entering the hydraulic drive device.

17 Claims, 8 Drawing Sheets

PRESSURE EXCHANGE SYSTEM WITH HYDRAULIC DRIVE SYSTEM

CROSS-REFERENCE TO RELATED APPLICATION

This application claims priority to and the benefit of U.S. Provisional Application No. 62/253,339, entitled "PRESSURE EXCHANGE SYSTEM WITH HYDRAULIC DRIVE SYSTEM," filed Nov. 10, 2015, the disclosure of which is hereby incorporated by reference in its entirety for all purposes.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Pressure exchangers may be used in a variety of industrial systems to transfer pressures between a high pressure first fluid and a low pressure second fluid. For example, a hydraulic fracturing system may use a pressure exchanger to transfer pressures between a high pressure non-abrasive fluid, such as water, and a low pressure, abrasive frac fluid containing a combination of water, chemicals, and proppant (e.g., sand, ceramics). By using the pressure exchanger to increase the pressure of the abrasive frac fluid, contact between the abrasive frac fluid and high pressure pumps of the hydraulic fracturing system may be reduced or blocked. Thus, the pressure exchanger may reduce abrasion and wear on the high pressure pumps, thus increasing the life and performance of the high pressure pumps.

One type of pressure exchanger is a rotary isobaric pressure exchanger (IPX). A rotary IPX generally includes a rotor having axial channels that establishes hydraulic communication between high pressure fluid and low pressure fluid. Rotation of the rotor may be driven by directional entry of fluid into the axial channels of the rotor. Accordingly, the rotational speed of the rotor may vary based on the flow rate and fluid density of fluids entering the rotor, among other variables, such as resistance of the rotor to rotation due to viscous losses and/or particle impediments. As such, the rotational speed of the rotor may be difficult to control.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
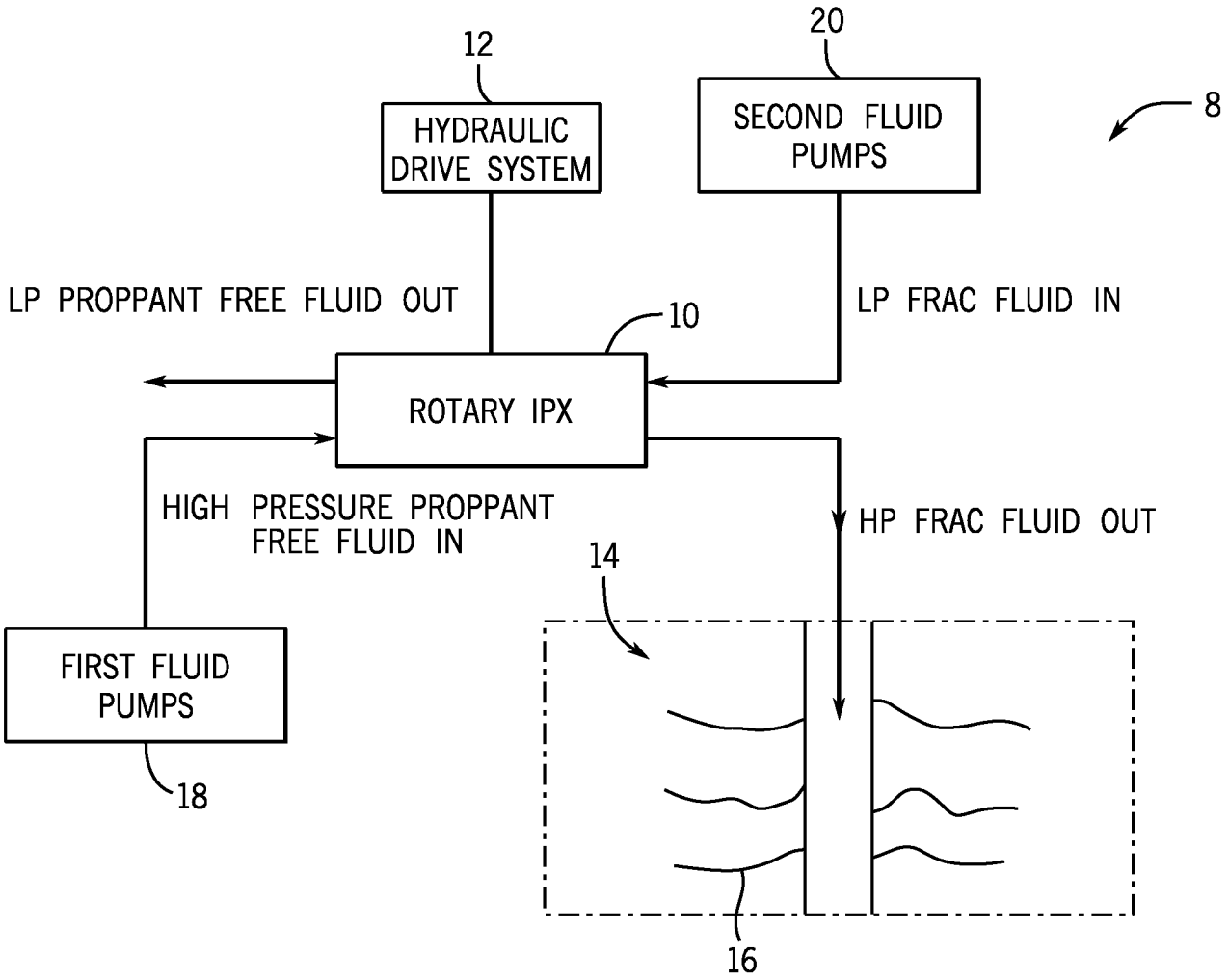
FIG. 1 is a schematic diagram of an embodiment of a fluid handling system with a rotary isobaric pressure exchanger (IPX) including a hydraulic drive system.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As discussed in detail below, a fluid handling system includes a rotary isobaric pressure exchanger (IPX) that transfers work and/or pressure between a first fluid and a second fluid with reduced, minimal, or no mixing of fluids exiting the rotary IPX. The rotary IPX includes a rotor having axial channels. In operation, a channel of the rotor receives incoming second fluid at low pressure, and rotation of the rotor rotates the channel to bring the second fluid within the channel in hydraulic communication with incoming first fluid at high pressure. The first fluid at high pressure enters the channel, and pressure from the first fluid is transferred to the second fluid, causing the second fluid to exit the rotor at high pressure. Further rotation of the channel brings the low pressure first fluid remaining in the channel in hydraulic communication with the incoming second fluid at low pressure. The second fluid enters the channel and drives the low pressure first fluid out of the rotor, and the process repeats with further rotation of the channel. A fluid interface forms between the first and second fluids in the channels, which functions as a fluid barrier to block mixing between the first and second fluids.

The performance of the rotary IPX may be dependent on the rotational speed of the rotor. For example, the rotor may slow if the rotor loading increases due to higher fluid viscosities or an increase of proppants or contaminants. Additionally, the rotor may stall if the torque applied by the fluid flows is insufficient. Further, the rotational speed, as well as the flow rates of the incoming fluid streams, affects the travel distance or displacement of the fluid interface. In particular, if the rotational speed is too high, then travel distance (i.e., duct utilization) may be undesirably small. A small travel distance may reduce the efficiency of the rotary IPX, for example due to fluid compressibility. Additionally, if the rotational speed is too slow and/or if the flow rate of one incoming fluid is greater than (e.g., significantly greater than) the flow rate of the other incoming fluid, then the travel distance may be undesirably large. A large travel distance may result in undesirable fluid mixing. In particular, incoming fluid from one end of the rotary IPX or a portion of the incoming fluid about the fluid interface may exit from the other end (i.e., the wrong end) of the rotary IPX, resulting in undesirable fluid mixing. Accordingly, it may be desirable to control the rotational speed of the rotor within a desired operating range to reduce or minimize inefficiencies of the rotary IPX and undesirable fluid mixing, thus increasing the performance of the rotary IPX. Further, it may be desirable to control the rotational speed of the rotor such that the rotational speed is directly proportional to the flow rate of the incoming high pressure fluid. Additionally, it may be desirable to control the incoming flow rates of the high pressure fluid and the low pressure fluid with respect to one another, for example by providing equal flow rates or constant ratios of flow rates. That is, it may be desirable to establish fixed relationships between the flow rates of the incoming fluids and between the flow rates and the rotational speed of the rotor to increase rotary IPX performance.

However, as noted above, the rotational speed of the rotor may be difficult to determine or control when rotation of the rotor is driven by directional entry of fluid into the axial channels of the rotor. To facilitate rotation at a desired speed, the rotary IPX may include an in-board electric motor or may be coupled to an out-board electric motor via the shaft of the rotary IPX. However, process fluid of the rotary IPX (e.g., high pressure first fluid or high pressure second fluid) may enter the in-board electric motor and may damage components, such as electrical components, of the electric motor. Further, the out-board electric motor may include a shaft seal about the shaft coupling the out-board electric motor to the rotary IPX to reduce, minimize, or block leakage of the process fluid of the rotary IPX into the out-board electric motor. However, the shaft seal may be exposed to a very high pressure differential (e.g., up to 10,000 kPa or greater) and particulates from the high pressure particle-laden fluid, which may wear and/or degrade the seal, cause leakage of process fluid across the seal, and/or cause the seal to extrude and/or fail. Still further, the in-board and out-board electric motors may not establish fixed relationships between the flow rates of incoming fluids of the rotary IPX and the rotational speed of the rotor.

As described in detail below, the present embodiments include a rotary IPX that includes a rotor and a hydraulic drive system integrated with the rotor. For example, the hydraulic drive system may be coupled to the rotor directly (e.g., disposed circumferentially around the rotor) or indirectly (e.g., via a shaft). The hydraulic drive system extracts power from a supplied flow and converts it to rotational power to drive the rotor and the shaft (if included). The hydraulic drive system may include at least one hydraulic drive device configured to receive a flow and convert energy from the flow to rotational energy to drive the shaft and/or the rotor. In some embodiments, the at least one hydraulic drive device may be configured use rotational energy from the shaft and/or the rotor to pump a fluid. Thus, the at least one hydraulic drive device may be configured to operate as a hydraulic turbine or a hydraulic motor, in which energy from the flow is used to drive the shaft and/or rotor, and/or to operate as a hydraulic pump, in which energy from the shaft and/or rotor is used to pump a fluid. In certain embodiments, the at least one hydraulic drive device may include one or more hydraulic turbines, one or more hydraulic motors, one or more positive displacement devices (e.g., fixed positive displacement device, constant flow device, hydrostatic device, etc.), or a combination thereof.

The hydraulic drive device may receive an incoming stream of fluid and may drive rotation of the shaft, and thus the rotor, at a rotational speed that varies with or is based on the flow rate of the incoming stream of fluid. In some embodiments, the hydraulic drive device may establish or control a substantially linear relationship (i.e., a substantially fixed relationship or a substantially constant relationship) between flow rate and rotational speed. That is, the hydraulic drive device may rotate the shaft, and thus the rotor, at a rotational speed that is substantially directly proportional to the flow rate of the incoming stream. As used herein, the terms "substantially linear," "substantially fixed, " "substantially constant," and "substantially directly proportional to" include a margin of error (e.g., 5%, 4%, 3%, 2%, 1%, or less) to account for inefficiencies of the hydraulic drive device, such as leakage. For example, in some embodiments, the hydraulic drive device may be a hydraulic motor or a positive displacement device that may be configured establish or control a substantially linear relationship between flow rate and rotational speed. In some embodiments, a positive displacement device may provide a more direct, linear relationship between flow rate and rotational speed (i.e., may have a lower margin of error) as compared to a hydraulic motor. Further, in some embodiments, the hydraulic drive device may establish or control a nonlinear relationship between flow rate and rotational speed. For example, in some embodiments, the rotational speed of a hydraulic turbine, and thus the rotational speed of the shaft and rotor, may vary with varying loads on the hydraulic turbine. However, the hydraulic drive system may be configured to vary the flow rate of the fluid entering the hydraulic drive device (e.g., a hydraulic turbine) to achieve a desired rotational speed of the hydraulic drive device, and therefore the rotational speed of the shaft and the rotor, even with varying loads on the hydraulic drive device.

Thus, the hydraulic drive system may control the rotational speed of the rotor within a desired operating range based on the flow rate of the fluid entering the hydraulic drive device. As such, the hydraulic drive system may increase the efficiency of the rotary IPX and reduce or minimize leakage of the rotary IPX. Additionally, in some embodiments, the hydraulic drive system may only include hydraulic components, and thus, the hydraulic drive system may not include any electrical components that may be damaged if exposed to fluids. Further, in some embodiments, the hydraulic drive system may be disposed within a housing or casing of the rotary IPX, and thus, the hydraulic drive system may enable the use of a low pressure shaft seal or no shaft seal at all between the hydraulic drive system and the rotor.

In certain embodiments, the hydraulic drive system may establish or control a relationship between the flow rate of at least one fluid (e.g., the high pressure first fluid or the low pressure second fluid) entering the rotor and the rotational speed of the rotor. For example, the high pressure first fluid may be used by the hydraulic drive system to drive rotation of the rotor. In some embodiments, all of the high pressure first fluid may flow through the hydraulic drive system before entering the rotor. As such, the hydraulic drive system may rotate the shaft, and thus the rotor, at a rotational speed that varies with, is based on, and/or is substantially directly proportional to the flow rate of the high pressure first fluid of the rotary IPX. As such, the hydraulic drive system may establish or control a relationship (e.g., a nonlinear relationship or a substantially linear relationship) between the rotational speed of the rotor and the flow rate of the high pressure first fluid of the rotary IPX.

Further, in some embodiments, the hydraulic drive system may establish or control a relationship between the flow rate of both fluids (e.g., the high pressure first fluid and the low pressure second fluid) entering the rotor and the rotational speed of the rotor. For example, the hydraulic drive system may include a second hydraulic drive device coupled to the rotor and the first hydraulic drive device via the shaft. In some embodiments, the second hydraulic drive device may receive low pressure first fluid exiting the rotor. Because the first hydraulic drive device and the second hydraulic drive device are coupled to a common shaft, the flow rate of the fluid (e.g., the high pressure first fluid) entering the first hydraulic drive device and the flow rate of the fluid (e.g., low pressure first fluid) entering the second hydraulic drive device may be substantially proportional to or the same as one another. For example, the rotational speed of the shaft may be set by the flow rate of the fluid entering the first hydraulic drive device, and the rotational speed of the shaft may set the flow rate of fluid entering the second hydraulic drive device. Additionally, the flow rate of the low pressure fluid entering the rotor (e.g., low pressure second fluid) may vary with (e.g., substantially proportional to or the same as) the flow rate of the fluid (e.g., low pressure first fluid) exiting the rotor and subsequently entering the second hydraulic drive device. As a result, the flow rate of the low pressure fluid entering the rotor (e.g., low pressure second fluid) may also vary with, be substantially proportional to, or be the same as the flow rate of the high pressure fluid (e.g., high pressure first fluid) entering the rotor and may vary with or be substantially proportional to the rotational speed of the rotor. As such, the hydraulic drive system may establish or control a relationship between the rotational speed of the rotor, the flow rate of the high pressure, incoming first fluid of the rotary IPX, and the flow rate of the low pressure, incoming second fluid of the rotary IPX.

FIG. 1 is a schematic diagram of an embodiment of a fluid handling system 8 with a rotary isobaric pressure exchanger (IPX) 10 including a hydraulic drive system 12. As explained above, the hydraulic drive system 12 is configured to rotate the rotary IPX 10 at a rotational speed that is based on, varies with, or is substantially proportional to the flow rate of fluid entering the hydraulic drive system 12. By controlling the rotational speed of the rotary IPX 10, the hydraulic drive system 12 may increase the efficiency of the rotary IPX 10 and may reduce or minimize mixing of the fluids processed by the rotary IPX 10.

As illustrated, the fluid handling system 8 may be a frac system 8. For example, during well completion operations, the frac system 8 pumps a pressurized particulate laden fluid that increases the release of oil and gas in rock formations 14 by propagating and increasing the size of cracks 16. In order to block the cracks 16 from closing once the frac system 8 depressurizes, the frac system 8 uses fluids that have solid particles, powders, debris, etc. that enter and keep the cracks 16 open.

In order to pump this particulate laden fluid into the well, the frac system 8 may include one or more first fluid pumps 20 (e.g., high pressure pumps) and one or more second fluid pumps 22 (e.g., low pressure pumps) coupled to the rotary IPX 10. In operation, the rotary IPX 10 transfers pressures without any substantial mixing between a first fluid (e.g., proppant-free fluid) pumped by the first fluid pumps 20 and a second fluid (e.g., proppant-containing fluid or frac fluid) pumped by the second fluid pumps 22. In this manner, the rotary IPX 10 blocks or limits wear on the first fluid pumps 20 (e.g., high pressure pumps), while enabling the frac system 8 to pump a high pressure frac fluid into the rock formation 16 (e.g., a well) to release oil and gas. In order to operate in corrosive and abrasive environments, the rotary IPX 10 may be made from materials resistant to corrosive and abrasive substances in either the first and second fluids. For example, the rotary IPX 10 may be made out of ceramics (e.g., alumina, cermets, such as carbide, oxide, nitride, or boride hard phases) within a metal matrix (e.g., Co, Cr or Ni or any combination thereof) such as tungsten carbide in a matrix of CoCr, Ni, NiCr or Co.

While the illustrated embodiment of the fluid handling system 8 is a frac system, it should be appreciated that the fluid handling system 8 may be any suitable system configured to utilize a high pressure fluid. For example, the fluid handling system 8 may include desalination systems, urea production systems, ammonium nitrate production systems, urea ammonium nitrate (UAN) production systems, polyamide production systems, polyurethane production systems, phosphoric acid production systems, phosphate fertilizer production systems, calcium phosphate fertilizer production systems, oil refining systems, oil extraction systems, petrochemical systems, pharmaceutical systems, or any other systems configured to handle abrasive and/or corrosive fluids.

Further, in certain embodiments, the first fluid may be a pressure exchange fluid or a clean fluid that is non-abrasive, non-corrosive, and/or substantially particulate free. For example, the first fluid may be water or a dielectric fluid, such as oil (e.g., mineral oil, castor oil, silicone oil, synthetic oil, etc.) and/or water (e.g., purified water, deionized water, distilled water, etc.). In certain embodiments, the second fluid may be a fluid that is abrasive, corrosive, and/or particulate-laden. The first and second fluids may be multiphase fluids such as gas/liquid flows, gas/solid particulate flows, liquid/solid particulate flows, gas/liquid/solid particulate flows, or any other multi-phase flow. For example, the multi-phase fluids may include sand, solid particles, powders, debris, ceramics, or any combination therefore. These fluids may also be non-Newtonian fluids (e.g., shear thinning fluid), highly viscous fluids, non-Newtonian fluids containing proppant, or highly viscous fluids containing proppant. Further, the first fluid may be at a first pressure between approximately 5,000 kPa to 25,000 kPa, 20,000 kPa to 50,000 kPa, 40,000 kPa to 75,000 kPa, 75,000 kPa to 100,000 kPa or greater than a second pressure of the second fluid.

Figure 2:
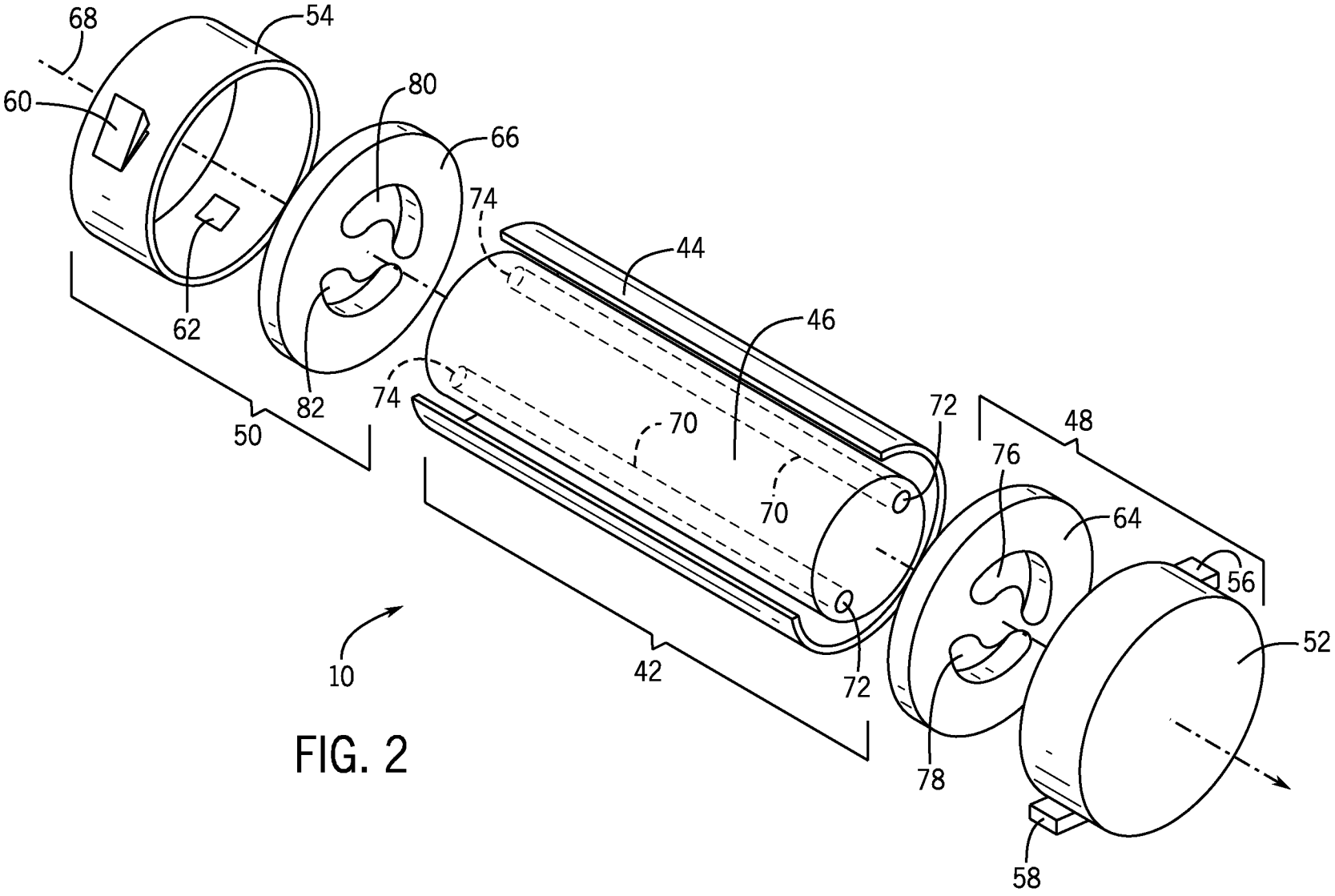
FIG. 2 is an exploded perspective view of an embodiment of a rotary IPX.

FIG. 2 is an exploded perspective view of an embodiment of the rotary IPX 10 capable of transferring pressure and/or work between a first fluid (e.g., a non-abrasive, non-corrosive, and/or substantially particulate free fluid) and a second fluid (e.g., an abrasive, corrosive, and/or particulate-laden fluid) with minimal mixing of the fluids. The rotary IPX 10 may include a generally cylindrical body portion 42 that includes a sleeve 44 (e.g., rotor sleeve) and a rotor 46. The rotary IPX 10 may also include two end caps 48 and 50 that include manifolds 52 and 54, respectively. Manifold 52 includes respective inlet and outlet ports 56 and 58, while manifold 54 includes respective inlet and outlet ports 60 and 62. In operation, these inlet ports 56, 60 enable the first and second fluids to enter the rotary IPX 10 to exchange pressure, while the outlet ports 58, 62 enable the first and second fluids to then exit the rotary IPX 10. In operation, the inlet port 56 may receive a high pressure first fluid, and after exchanging pressure, the outlet port 58 may be used to route a low pressure first fluid out of the rotary IPX 10. Similarly, the inlet port 60 may receive a low pressure second fluid, and the outlet port 62 may be used to route a high pressure second fluid out of the rotary IPX 10. The end caps 48 and 50 include respective end covers 64 and 66 disposed within respective manifolds 52 and 54 that enable fluid sealing contact with the rotor 46. The rotor 46 may be cylindrical and disposed in the sleeve 44, which enables the rotor 46 to rotate about the axis 68. The rotor 46 may have a plurality of channels 70 (e.g., axial channels) extending substantially longitudinally through the rotor 46 with openings 72 and 74 at each end arranged symmetrically about the longitudinal axis 68. The openings 72 and 74 of the rotor 46 are arranged for hydraulic communication with inlet and outlet apertures 76 and 78; and 80 and 82 in the end covers 52 and 54, in such a manner that during rotation the channels 70 are exposed to fluid at high pressure and fluid at low pressure. As illustrated, the inlet and outlet apertures 76 and 78; and 80 and 82 may be designed in the form of arcs or segments of a circle (e.g., C-shaped).

FIGS. 3-6 are exploded views of an embodiment of the rotary IPX 10 illustrating the sequence of positions of a single channel 70 in the rotor 46 as the channel 70 rotates through a complete cycle. It is noted that FIGS. 3-6 are simplifications of the rotary IPX 10 showing one channel 70, and the channel 70 is shown as having a circular cross-sectional shape. In other embodiments, the rotary IPX 10 may include a plurality of channels 70 with the same or different cross-sectional shapes (e.g., circular, oval, square, rectangular, polygonal, etc.). Thus, FIGS. 3-6 are simplifications for purposes of illustration, and other embodiments of the rotary IPX 10 may have configurations different from that shown in FIGS. 3-6. As described in detail below, the rotary IPX 10 facilitates pressure exchange between first and second fluids (e.g., proppant-free fluid and proppant-laden fluid) by enabling the first and second fluids to briefly contact each other within the rotor 46. In certain embodiments, this exchange happens at speeds that result in limited mixing of the first and second fluids.

Figures 3, 4, 5, 6:
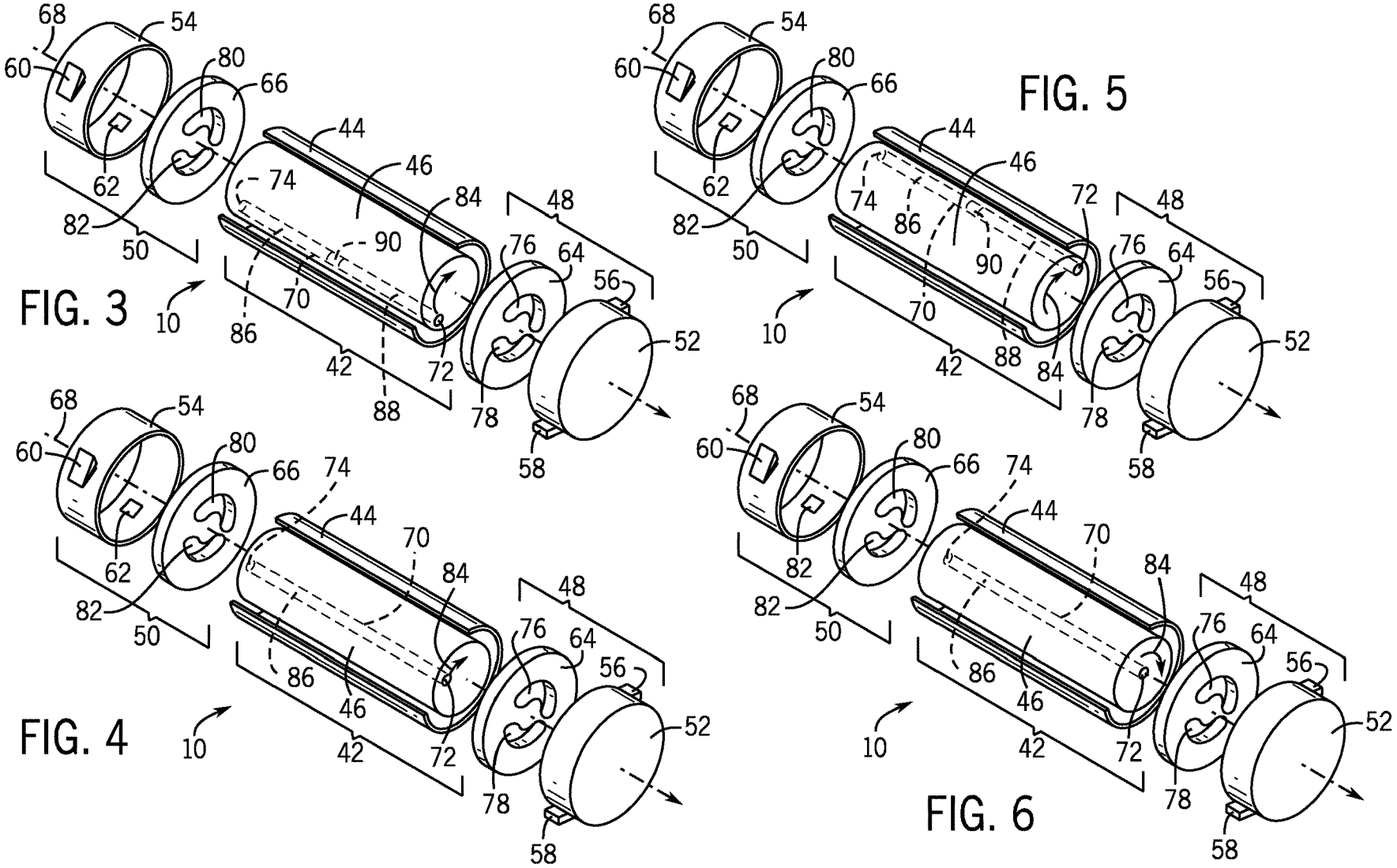
FIG. 3 is an exploded perspective view of an embodiment of a rotary IPX in a first operating position.
FIG. 4 is an exploded perspective view of an embodiment of a rotary IPX in a second operating position.
FIG. 5 is an exploded perspective view of an embodiment of a rotary IPX in a third operating position.
FIG. 6 is an exploded perspective view of an embodiment of a rotary IPX in a fourth operating position.

In FIG. 3, the channel opening 72 is in a first position. In the first position, the channel opening 72 is in fluid communication with the aperture 78 in endplate 64 and therefore with the manifold 52, while the opposing channel opening 74 is in hydraulic communication with the aperture 82 in end cover 66 and by extension with the manifold 54. As will be discussed below, the rotor 46 may rotate in the clockwise direction indicated by arrow 84. In operation, low-pressure second fluid 86 passes through end cover 66 and enters the channel 70, where it contacts the first fluid 88 at a dynamic fluid interface 90 (e.g., fluid barrier). The second fluid 86 then drives the first fluid 88 out of the channel 70, through end cover 64, and out of the rotary IPX 10. However, because of the short duration of contact, there is minimal mixing between the second fluid 86 and the first fluid 88.

In FIG. 4, the channel 70 has rotated clockwise through an arc of approximately 90 degrees. In this position, the outlet 74 is no longer in fluid communication with the apertures 80 and 82 of end cover 66, and the opening 72 is no longer in fluid communication with the apertures 76 and 78 of end cover 64. Accordingly, the low-pressure second fluid 86 is temporarily contained within the channel 70.

In FIG. 5, the channel 70 has rotated through approximately 60 degrees of arc from the position shown in FIG. 6. The opening 74 is now in fluid communication with aperture 80 in end cover 66, and the opening 72 of the channel 70 is now in fluid communication with aperture 76 of the end cover 64. In this position, high-pressure first fluid 88 enters and pressurizes the low-pressure second fluid 86 driving the second fluid 86 out of the fluid channel 70 and through the aperture 80 for use in the fluid handling system 8.

In FIG. 6, the channel 70 has rotated through approximately 270 degrees of arc from the position shown in FIG. 6. In this position, the outlet 74 is no longer in fluid communication with the apertures 80 and 82 of end cover 66, and the opening 72 is no longer in fluid communication with the apertures 76 and 78 of end cover 64. Accordingly, the first fluid 88 is no longer pressurized and is temporarily contained within the channel 70 until the rotor 46 rotates another 90 degrees, starting the cycle over again.

Figure 7:
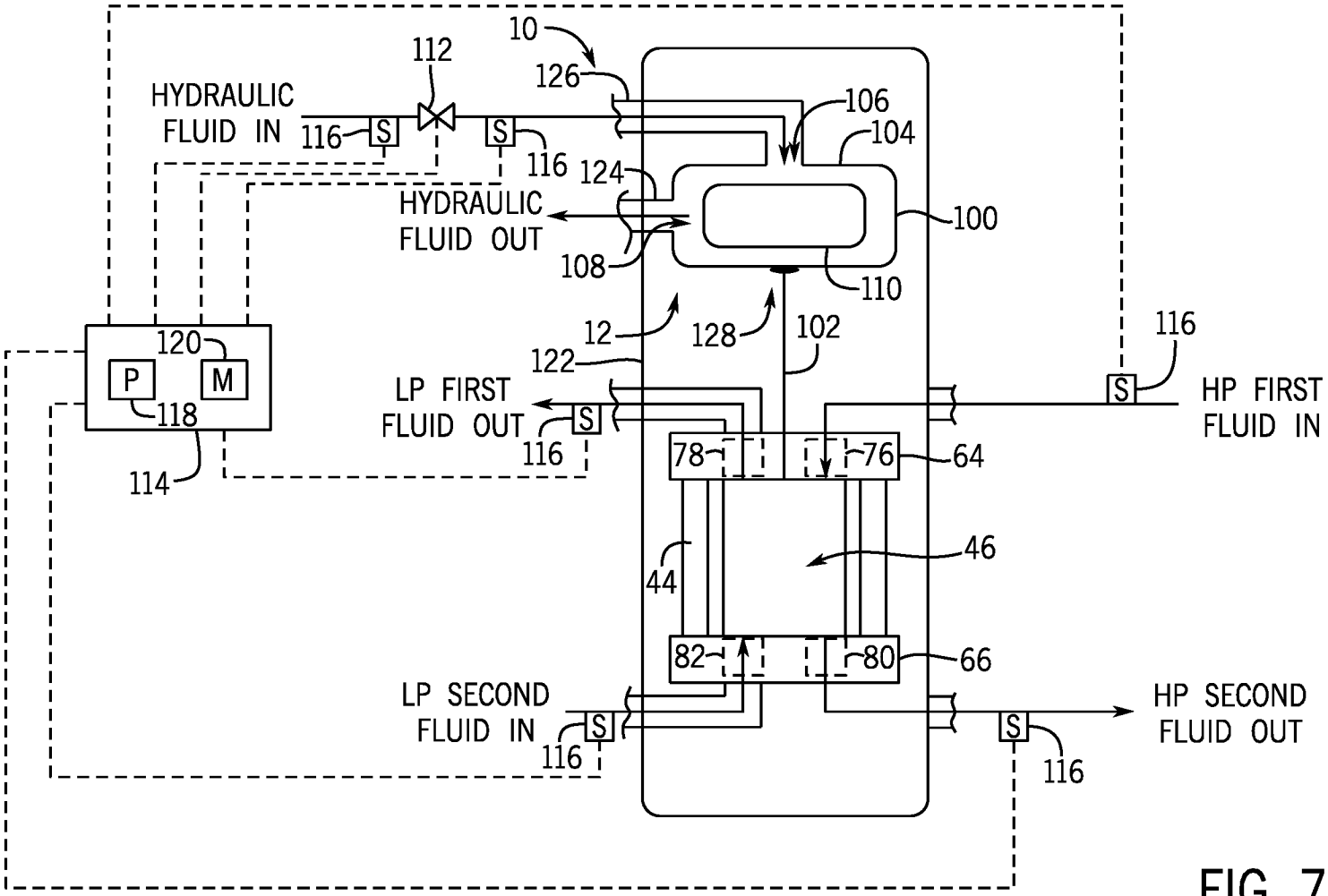
FIG. 7 is a cross-sectional view of an embodiment of a rotary IPX with a hydraulic drive system that includes a first hydraulic drive device configured to use a hydraulic fluid to drive rotation of the rotary IPX.

FIG. 7 is a cross-sectional view of an embodiment of the rotary IPX 10 and the hydraulic drive system 12 that is configured to control the rotational speed of the rotor 46 based on the flow rate of fluid entering the hydraulic drive system 12. As illustrated, the hydraulic drive system 12 includes a first hydraulic drive device 100 (e.g., hydraulic turbine, hydraulic motor, positive displacement device, fixed positive displacement device, constant flow device, hydrostatic device, etc.) coupled to the rotor 46 of the rotary IPX 10 via a shaft 102. The first hydraulic drive device 100 may be configured to operate as a hydraulic motor or a hydraulic turbine to drive rotation of the shaft 102. For example, the first hydraulic drive device 100 may include a hydraulic turbine, a hydraulic motor, a rotary motor, such as a gear motor (e.g., an external gear motor or an internal gear motor), a gerotor motor, a geroller motor, a vane motor, a lobe motor, a piston motor, a flexible impeller motor, a peristaltic motor, and so forth. The first hydraulic drive device 100 may additionally or alternatively include a reciprocating motor, such as a piston motor, a diaphragm motor, and so forth. As noted above, certain positive displacement devices may be configured to operate as both a hydraulic turbine or motor and a hydraulic pump. Accordingly, it should be appreciated that the first hydraulic drive device 100 may also be configured to operate as a hydraulic pump (e.g., when rotation of the shaft 102 drives displacement of fluid from the first hydraulic drive device 100). Thus, the first hydraulic drive device 100 may also be referred to as a hydraulic pump, a rotary pump, such as a gear pump (e.g., an external gear pump or an internal gear pump), a gerotor pump, a geroller pump, a vane pump, a lobe pump, a piston pump, a flexible impeller pump, a peristaltic pump, a screw pump, and so forth, or a reciprocating pump, such as a piston pump or a diaphragm pump.

The first hydraulic drive device 100 may include a housing 104 (e.g., a stationary component), an inlet port 106 through the housing 104, an outlet port 108 through the housing 104, and a rotating or reciprocating component 110 disposed in the housing 104. As will be appreciated, the rotating or reciprocating component 110 may vary based on the type of hydraulic drive device (e.g., gear motor, vane motor, piston motor, etc.). In operation, the first hydraulic drive device 100 receives a flow of fluid (e.g., hydraulic fluid) through the inlet port 106 and converts the hydraulic energy of the hydraulic fluid into mechanical energy to drive rotation of the rotor 46 and the shaft 102 (if included). In particular, the hydraulic fluid actuates the rotating or reciprocating component 110, which drives rotation of the rotor 46 and the shaft 102 (if included). For example, the rotating or reciprocating component 110 may be directly coupled to the rotor 46 or indirectly coupled to the rotor 46 via the shaft 102 (e.g., the shaft 102 is coupled to and extends between the rotating or reciprocating component 110 and the rotor 46). The hydraulic fluid is then discharged through the outlet port 108. As noted above, the rotational speed of the shaft 102 and therefore the rotor 46 is based on, varies with, or substantially directly proportional to the flow rate of the hydraulic fluid entering the first hydraulic drive device 100. Thus, the flow rate of the hydraulic fluid entering the first hydraulic drive device 100 may be selected to achieve a desired rotational speed of the rotor 46. As such, the hydraulic drive system 12 may enable the rotor 46 to operate at a desired rotational speed or within a desired range of rotational speeds, which may reduce or minimize inefficiencies of the rotary IPX 10 and may reduce or minimize fluid mixing, thus increasing the performance of the rotary IPX 10. Further, the hydraulic drive system 12 may enable a broader range of flow rates to drive rotation of the rotor 46 as compared to systems in which fluid impinging the rotor 46 at an angle drives rotation of the rotor 46.

In some embodiments, the hydraulic drive system 12 may include a valve 112 to adjust or control the flow rate of the hydraulic fluid entering the first hydraulic drive device 100 and thus, the rotational speed of the rotor 46. In certain embodiments, the valve 112 may be manually adjusted. In some embodiments, the valve 112 may be a control valve 112 that is controlled (e.g., adjusted) by a controller 114 (e.g., an electronic controller, an electronic control unit, a processor-based controller, etc.). In some embodiments, the controller 114 may be operatively coupled to one or more sensors 116 (e.g., flow sensors, flow meters, pressure sensors, torque sensors, rotational speed sensors, acoustic sensors, magnetic sensors, optical sensors, etc.) and may use feedback from the one or more sensors 116 to control the control valve 112 to achieve a desired flow rate of the hydraulic fluid entering the first hydraulic drive device 100. For example, the controller 114 may use the feedback from the one or more sensors 116 to determine the flow rate of the hydraulic fluid, may compare the flow rate of the hydraulic fluid to a flow rate threshold, and may control or adjust the control valve 112 based on the comparison (e.g., to set the flow rate of the fluid to the flow rate threshold). In some embodiments, the controller 114 may receive feedback from one or more sensors 116 configured to monitor one or more parameters (e.g., flow rate and/or pressure) of the incoming high pressure first fluid, the incoming low pressure second fluid, the exiting low pressure first fluid, and/or the exiting high pressure second fluid. The controller 114 may include a processor 118 and a memory 120 (e.g., a tangible, non-transitory memory) that stores one or more flow rate thresholds and non-transitory computer instructions executable by the processor 118. For example, the processor 118 may select a flow rate threshold from a plurality of flow rate thresholds stored in the memory 120 to achieve a desired rotational speed of the rotor 46, and the processor 118 may execute instructions stored in the memory 120 to control the control valve 112 and therefore the flow rate of hydraulic fluid entering the first hydraulic drive device 100 based on the selected flow rate threshold and feedback from the one or more sensors 116. It should be appreciated that in some embodiments, the hydraulic drive system 12 may not include the valve 112, the one or more sensors 116, and/or the controller 114.

As illustrated, the first hydraulic drive device 100 may be disposed in a casing 122 (e.g., housing) of the rotary IPX 10. The casing 122 of the rotary IPX 10 also houses the rotor 46, the end cover 64, and the end cover 66. While the first hydraulic drive device 100 and the shaft 102 are disposed on the first fluid side of the rotary IPX 10 in the illustrated embodiment, the first hydraulic drive device 100 and the shaft 102 may be disposed on the second fluid side of the rotary IPX 10 in other embodiments. The casing 122 may include an inlet port 124 to receive the hydraulic fluid and to direct the hydraulic fluid to the inlet port 106 of the first hydraulic drive device 100. In some embodiments, the casing 122 may include an outlet port 126 to receive the hydraulic fluid from the outlet port 108 of the first hydraulic drive device 100 and to discharge the hydraulic fluid from the casing 122. Thus, the hydraulic drive system 12 may be a closed loop system in that the hydraulic fluid utilized by the first hydraulic drive device 100 is not processed by the rotary IPX 10 (e.g., is not used as the high pressure, incoming first fluid or the low pressure, incoming second fluid). Additionally, the rotary IPX 10 may include a shaft seal 128 disposed about the shaft 102 to reduce, minimize, or block leakage of fluid into and out of the first hydraulic drive device 100 to reduce, minimize, or block mixing of the hydraulic fluid of the first positive displacement device 100 and the process fluid of the rotary IPX 10 (e.g., the first fluid and/or the second fluid).

Because the hydraulic drive system 10 is a closed loop system and fluid mixing between the first positive displacement device and the rotary IPX 10 may be reduced, minimized, or blocked, the first hydraulic drive device 100 may use any suitable hydraulic fluid. For example, the hydraulic fluid may be hydraulic oil, water, or a dielectric fluid, such as oil (e.g., mineral oil, castor oil, silicone oil, etc.), purified water, and so forth. In some embodiments, the hydraulic fluid may be a process fluid from the fluid handling system 8, such as a waste fluid. In some embodiments, the hydraulic fluid may be provided by one or more pump trucks of the fluid handling system 8 (e.g., a frac system). Additionally, the hydraulic fluid may be at high pressure. For example, the pressure of the hydraulic fluid may be approximately 5,000 kPa to 25,000 kPa, 20,000 kPa to 50,000 kPa, 40,000 kPa to 75,000 kPa, 75,000 kPa to 100,000 kPa. In some embodiments, the pressure of the hydraulic fluid may be substantially the same as the pressure of the high pressure first fluid and/or the high pressure second fluid. For example, the pressure of the hydraulic fluid may be within approximately 10%, 9%, 8%, 7%, 6%, 5%, 4%, 3%, 2%, 1%, or less of the pressure of the high pressure first fluid and/or the high pressure second fluid. This may be desirable to reduce the pressure differential across the shaft seal 128, which may enable the use of a low pressure shaft seal 128 (e.g., between approximately 500 kPa to 2,000 kPa), may reduce leakage of fluid across the shaft seal 128, may reduce wear and degradation of the shaft seal 128, and may reduce the occurrence of extrusion of the shaft seal 128.

In some embodiments, the first hydraulic drive device 100 may be external to the casing 122 of the rotary IPX 10. For example, the housing 104 of the first hydraulic drive device 100 may be disposed adjacent to (e.g., in physical contact with) the casing 122 of the rotary IPX 10, and the shaft seal 128 may be disposed between the housing 104 and the casing 122. In such an arrangement, the shaft seal 128 may not be exposed to ambient pressure, which may enable the use of a low pressure shaft seal 128. In certain embodiments, the first hydraulic drive device 100 may be external to and spaced apart from the casing 122 of the rotary IPX 10. However, the shaft seal 128 may be exposed to ambient pressure and thus a high pressure differential in such an arrangement, which may not enable the use of a low pressure shaft seal 128, may increase leakage of fluid across the shaft seal 128, may increase wear and degradation of the shaft seal 128, and may increase the occurrence of extrusion of the shaft seal 128.

Figure 8:
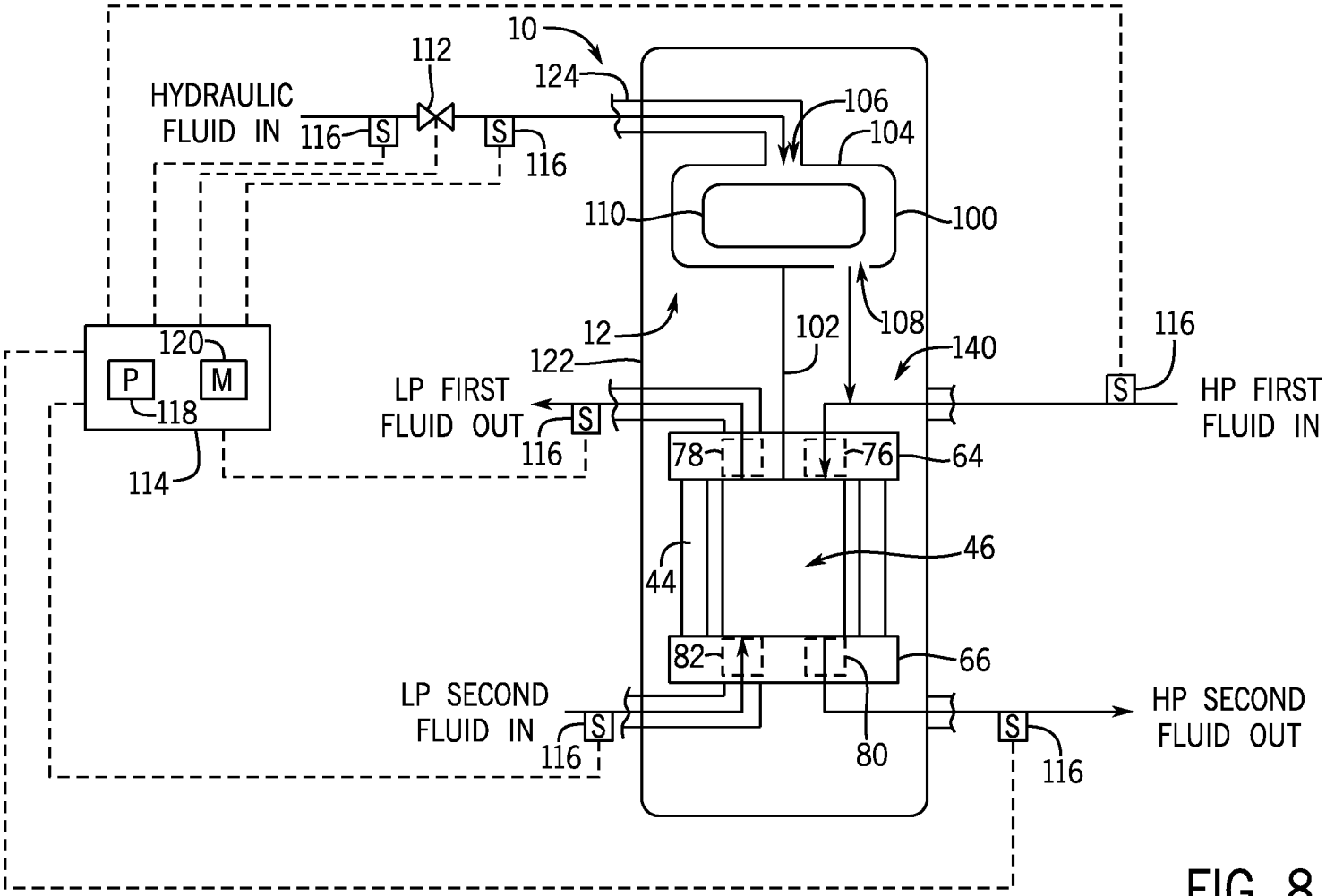
FIG. 8 is a cross-sectional view of an embodiment of a rotary IPX with a hydraulic drive system in which hydraulic fluid of the hydraulic drive system is used to drive rotation of the rotary IPX and is combined with a process fluid of the rotary IPX.

FIG. 8 is a cross-sectional view of an embodiment of the rotary IPX 10 and the hydraulic drive system 12 in which hydraulic fluid from the hydraulic system 12 is combined with a process fluid of the rotary IPX 10 (e.g., the high pressure first fluid or low pressure second fluid). As illustrated, the hydraulic drive system 12 includes the first hydraulic drive device 100, which is disposed in the casing 122 of the rotary IPX 10. The first hydraulic drive device 100 includes the housing 104, the inlet port 106, the outlet port 108, and the reciprocating or rotating component 110, as described above in FIG. 7. Additionally, the casing 122 of the rotary IPX 10 may include the inlet port 124 configured to receive the hydraulic fluid and to direct the hydraulic fluid to the inlet port 106 of the first hydraulic drive device 100. However, in the illustrated embodiment, the casing 122 does not include the outlet port 126 configured to receive the hydraulic fluid from the outlet port 108 and to discharge the hydraulic fluid from the casing 122. Instead, the hydraulic fluid discharged from the outlet port 108 of the first hydraulic drive device 100 is configured to mix with (e.g., join) a process fluid of the rotary IPX 40, such as the high pressure first fluid or the low pressure second fluid. For example, the hydraulic fluid discharged from the outlet port 108 may enter a high pressure first fluid chamber 140 (e.g., a mixing chamber). The high pressure first fluid chamber 140 may also receive the high pressure first fluid, and the hydraulic fluid may mix with the high pressure first fluid in the high pressure first fluid chamber 140 to form a fluid mixture. Thus, a mixture of the hydraulic fluid and the high pressure first fluid may flow through the aperture 76 of the end cover 64 and may pressurize the low pressure second fluid in the channels 70. In some embodiments, the hydraulic fluid discharged from the outlet port 108 may be mixed with the low pressure second fluid. For example, the casing 122 may include a port or channel (not shown) to direct the hydraulic fluid from the outlet port 108 to the aperture 82 of the end cover 66. In some embodiments, the first hydraulic drive device 100 may be disposed on the second fluid side of the rotary IPX 10.

The illustrated embodiment of the hydraulic drive system 12 may be referred to as a partial open loop system in that the hydraulic fluid discharged from the first hydraulic drive device 100 combines with another fluid of the rotary IPX 10 (e.g., the high pressure first fluid or the low pressure second fluid) and is used by the rotary IPX 10. In such embodiments, the hydraulic fluid may include a fluid that is compatible with the rotary IPX 10, such as, for example, water, purified water, reflux water, makeup water, boiler feed water, recycled water, ammonia, condensate, etc. Additionally, because the hydraulic fluid may be configured to mix with a process fluid of the rotary IPX 10, the rotary IPX 10 may not include the shaft seal 128, or leakiness of the shaft seal 128 may be acceptable. Further, the pressure of the hydraulic fluid may be greater than the pressure of the high pressure first fluid in order to produce sufficient torque to achieve a desired rotational speed of the shaft 102 and the rotor 46. In some embodiments, the pressure of the hydraulic fluid may be approximately 105%, 110%, 115%, 120%, 125%, or more of the pressure of the high pressure first fluid.

Figure 9:
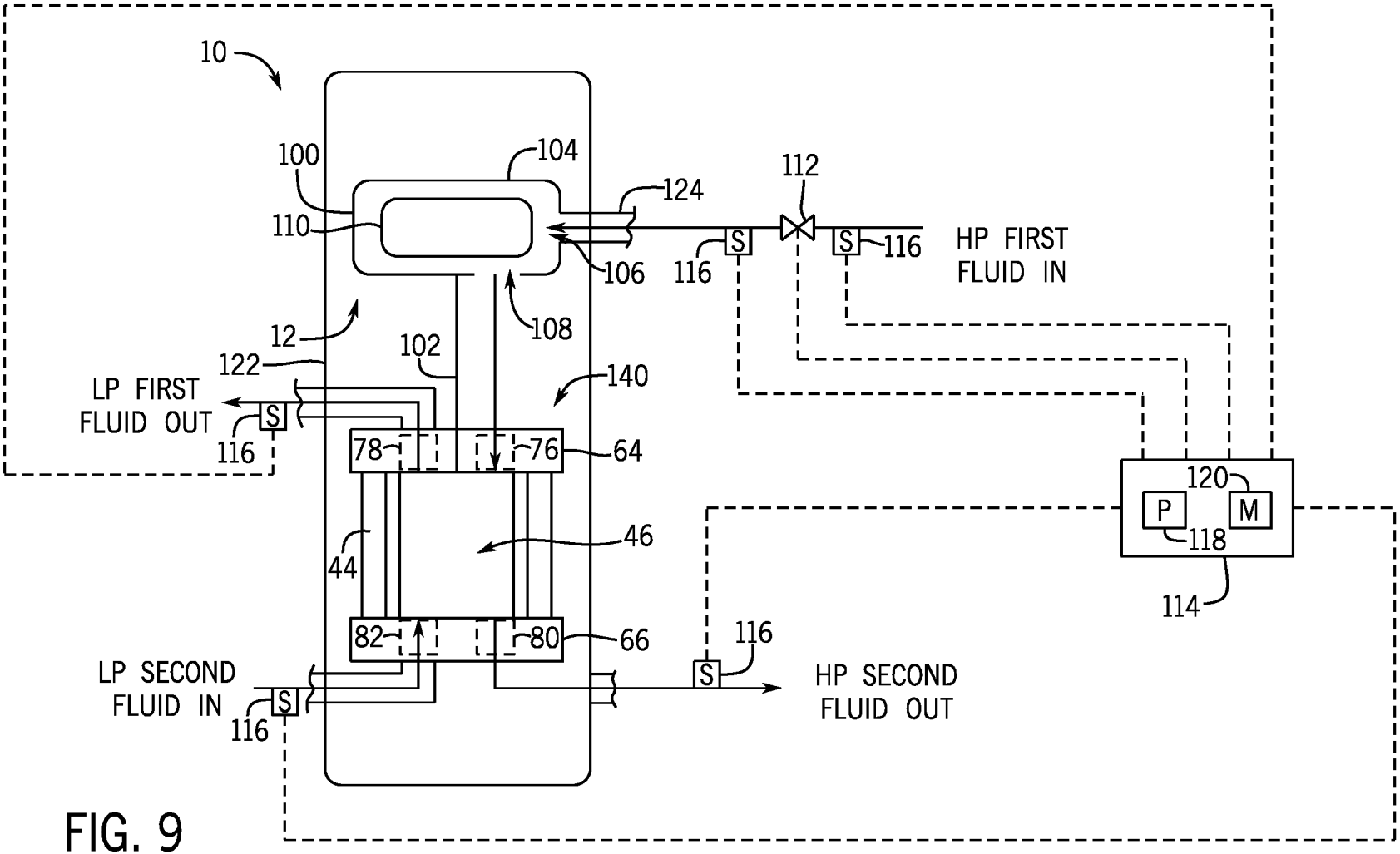
FIG. 9 is a cross-sectional view of an embodiment of a rotary IPX and with a hydraulic drive system configured to use a high pressure process fluid of the rotary IPX to drive rotation of the rotary IPX.

FIG. 9 is a cross-sectional view of an embodiment of the rotary IPX 10 and the hydraulic drive system 12 in which the high pressure first fluid is used by the hydraulic drive system 12 to drive rotation of the rotor 46 of the rotary IPX 10. As illustrated, the hydraulic drive system 12 includes the first hydraulic drive device 100, which is disposed in the casing 122 of the rotary IPX 10. The first hydraulic drive device 100 includes the housing 104, the inlet port 106, the outlet port 108, and the reciprocating or rotating component 110, as described above in FIG. 7. However, in the illustrated embodiment, the inlet port 124 of the casing 122 is configured to receive the high pressure first fluid and to direct the high pressure first fluid to the first hydraulic drive device 100, which uses the hydraulic energy of the high pressure first fluid to drive rotation of the shaft 102 and therefore the rotor 46. After driving rotation of the shaft 102, the high pressure first fluid is discharged from the outlet port 108 of the first hydraulic drive device 100, enters the high pressure first fluid chamber 140, and flows through the aperture 76 of the end cover 64 and into a channel 70 of the rotor 46 to pressurize low pressure second fluid in the channel 70. In some embodiments, the rotary IPX 10 may not include the shaft seal 128 because the first hydraulic drive device 100 receives the high pressure first fluid and thus, leakage into or out of the first hydraulic drive device 100 may not occur or may not be problematic in limited amounts.

By using the high pressure first fluid in the first hydraulic drive device 100, the flow rate of the high pressure fluid entering the first hydraulic drive device 100 controls or establishes the rotational speed of the shaft 102. Thus, the hydraulic drive system 12 controls or establishes a relationship (e.g., a nonlinear relationship or a substantially linear relationship) between the flow rate of the high pressure first fluid and the rotational speed of the rotor 46. In some embodiments, the rotational speed of the rotor 46 may be substantially proportional to the flow rate of the high pressure first fluid. As noted above, a rotational speed of the rotor 46 that is substantially proportional to the flow rate of the high pressure first fluid may reduce or minimize inefficiencies of the rotary IPX 10 and may reduce or minimize undesirable fluid mixing, thus increasing the performance of the rotary IPX 10.

Further, in some embodiments, the hydraulic drive system 12 may include the valve 112, the one or more sensors 116, and/or the controller 114, as described above with respect to FIG. 7, to adjust or control the flow rate of the high pressure first fluid entering the first positive displacement device 100. For example, the processor 118 may select a flow rate threshold from a plurality of flow rate thresholds stored in the memory 120 to achieve a desired rotational speed of the rotor 46, and the processor 118 may execute instructions stored in the memory 120 to control the control valve 112 and therefore the flow rate of high pressure first fluid entering the first positive displacement device 100 based on the selected flow rate threshold and feedback from the one or more sensors 116. However, it should be appreciated that in some embodiments, the hydraulic drive system 12 may not include the valve 112, the one or more sensors 116, and/or the controller 114. Indeed, the illustrated embodiment of the hydraulic drive system 12 in FIG. 9 may automatically control the rotational speed of the rotor 46 based on the flow rate of high pressure first fluid entering the first hydraulic drive device 100 without using the controller 114.

Figure 10:
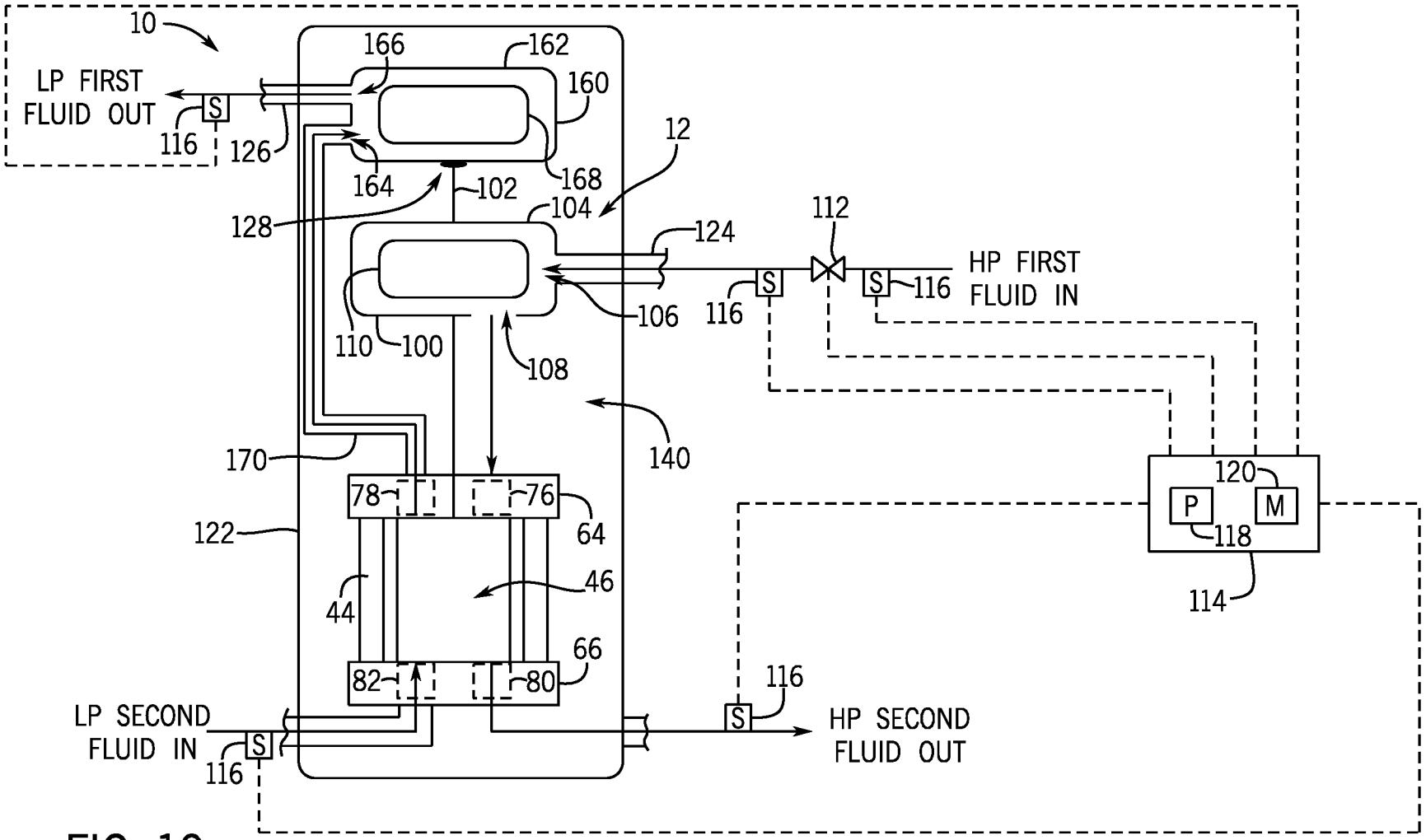
FIG. 10 is a cross-sectional view of an embodiment of a rotary IPX and with a hydraulic drive system that includes a first hydraulic drive device and a second hydraulic drive device.

FIG. 10 is a cross-sectional view of an embodiment of the rotary IPX 10 and the hydraulic drive system 12 that includes the first hydraulic drive device 100 and a second hydraulic drive device 160 coupled to the first hydraulic drive device 100 and the rotor 46. As illustrated, the first hydraulic drive device 100, the second hydraulic drive device 160, and the rotor 46 are each coupled to the shaft 102. As such, the first hydraulic drive device 100, the second hydraulic drive device 160, the rotor 46, and the shaft 102 will each rotate at the same rotational speed. The second hydraulic drive device 160 may be configured to operate as a hydraulic pump (e.g., a positive displacement pump) that uses rotational energy of the rotating shaft 102 to displace or pump a fluid. For example, the second hydraulic drive device 160 may include a rotary pump, such as a gear pump (e.g., an external gear pump or an internal gear pump), a gerotor pump, a geroller pump, a vane pump, a lobe pump, a piston pump, a flexible impeller pump, a peristaltic pump, a screw pump (e.g., twin screw pump or multi screw pump), and so forth. The second hydraulic drive device 160 may additionally or alternatively include a reciprocating pump, such as a piston pump, a diaphragm pump, and so forth. As noted above, certain hydraulic drive devices may be configured to operate as both a hydraulic motor or turbine and a hydraulic pump. Accordingly, it should be appreciated that the second hydraulic drive device 160 may also be configured to operate as a hydraulic motor or turbine. Thus, the second hydraulic drive device 160 may also be referred to as a hydraulic turbine, a hydraulic motor, a rotary motor, such as a gear motor (e.g., an external gear motor or an internal gear motor), a gerotor motor, a geroller motor, a vane motor, a lobe motor, a piston motor, a flexible impeller motor, a peristaltic motor, a diaphragm motor, and so forth.

The second hydraulic drive device 160 may include a housing 162 (e.g., a stationary component), an inlet port 164 through the housing 162, an outlet port 166 through the housing 162, and a rotating or reciprocating component 168 disposed in the housing 162. As will be appreciated, the rotating or reciprocating component 138 may vary based on the type of hydraulic drive device (e.g., gear pump, vane pump, piston pump, etc.). In operation, the first hydraulic drive device 100 may drive rotation of the shaft 102, which drives rotation or actuation of the rotating or reciprocating component 168 of the second hydraulic drive device 160 because the second hydraulic drive device 160 is coupled to the shaft 102. The second hydraulic drive device 160 may receive a flow of fluid through the inlet port 164 and may use the mechanical energy of the rotating or reciprocating component 168 to pump or displace the fluid, which is then discharged through the outlet port 166. As illustrated, the second hydraulic drive device 160 may be configured to receive the low pressure first fluid. In some embodiments, the second hydraulic drive device 160 may be configured to receive the low pressure second fluid. Additionally, it should be noted that the role of pump and motor between the first and second hydraulic drive devices 100 and 160 may reverse depending on conditions. The common shaft 102 makes it so the flow that would otherwise flow faster has energy extracted from it by the hydraulic device receiving the faster flow, and the extracted energy is conveyed to the other hydraulic device that acts as a pump on the fluid that would otherwise flow slower. Thus flow is balanced, and rotational speed is synchronized.

In some embodiments, the first and second hydraulic drive devices 100 and 160 may be disposed in the casing 122 of the rotary IPX 10. Additionally, the inlet port 124 of the casing 122 may be configured to receive the high pressure first fluid and to direct the high pressure first fluid to the first hydraulic drive device 100, as described above in FIG. 9. Further, the outlet port 126 of the casing 122 may be configured to receive fluid from the outlet port 166 of the second hydraulic drive device 160 and to discharge the fluid from the casing 122. Additionally, the casing 122 may include a port or channel 170 configured to route low pressure fluid of the rotary IPX 10 (e.g., the low pressure first fluid or the low pressure second fluid) to the inlet port 164 of the second hydraulic drive device 160. The channel 170 may be configured to separate the low pressure fluid from the high pressure fluid in the high pressure fluid chambers of the rotary IPX 10 (e.g., the high pressure first fluid chamber 140). Additionally, to reduce mixing between the high pressure fluids and the low pressure fluids of the rotary IPX 10, the shaft seal 128 may be disposed between the first hydraulic drive device 100 and the second hydraulic drive device 160.

As noted above, the rotational speed of the second hydraulic drive device 160 determines or sets the flow rate of fluid entering the second hydraulic drive device 160. Further, as noted above, the flow rate of the fluid (e.g., hydraulic fluid or high pressure first fluid) entering the first hydraulic drive device 100 determines or sets the rotational speed of the shaft 102 and therefore the rotor 46 and the second hydraulic drive device 160. Thus, the hydraulic drive system 12 including the first and second positive displacement devices 100 and 160 establishes or controls a relationship (e.g., a nonlinear relationship or a substantially linear relationship) between the flow rate of fluid entering the first hydraulic drive device 100, the flow rate of fluid entering the second hydraulic drive device 160, and the rotational speed of the rotor 46. Further, by routing the high pressure first fluid through the first hydraulic drive device 100 and low pressure fluid of the rotary IPX 10 (e.g., the low pressure first fluid or the low pressure second fluid) through the second hydraulic drive device 100, the hydraulic drive system 12 establishes or controls a relationship (e.g., a substantially fixed relationship) between the flow rates of the fluids entering the rotor 46 (e.g., the high pressure first fluid and the low pressure second fluid) and the rotational speed of the rotor 46. In particular, the rotational speed of the rotor 46 may be substantially directly proportional to the flow rate of the high pressure first fluid entering the rotor 46 and substantially directly proportional to the flow rate of the low pressure second fluid entering the rotor 46. Further, the flow rate of the high pressure first fluid entering the rotor 46 may be substantially directly proportional to or the same as the flow rate of the low pressure second fluid entering the rotor 46. As noted above, a rotational speed of the rotor 46 that is substantially proportional to the flow rates of the fluids entering the rotor 46 may reduce or minimize inefficiencies of the rotary IPX 10 and may reduce or minimize undesirable fluid mixing, thus increasing the performance of the rotary IPX 10.

Additionally, coupling the flow rates of the fluids entering the rotor 46 with the rotational speed of the rotor 46 using the first and second hydraulic drive devices 100 and 160 may be desirable for stall conditions of the rotor 46. For example, if the rotor 46 stalls (e.g., due to ingestion of a rock or other large solid) and rotation of the shaft 102 ceases, the first and second hydraulic drive devices 100 and 160 will automatically cease flow of the high pressure first fluid and the low pressure second fluid entering the rotor 46. That is, the first and second hydraulic drive devices 100 and 160 may stop flow of fluid into the rotor 46 without using any instrumentation (e.g., electronic instrumentation), such as valves, sensors, and/or controllers, to detect the stalled condition and/or to stop flow of fluid into the rotor 46. Accordingly, while the illustrated embodiment includes the controller 114, the valves 112, and the sensor 116, it should be appreciated that they may not be included. Indeed, the hydraulic drive system 12 may automatically control the rotational speed of the rotor 46 and the relationship between the flow rates of fluids entering the rotor 46 based on the flow rates of fluids entering the first and second hydraulic drive devices 100 and 160 without using the controller 114.

Figure 11:
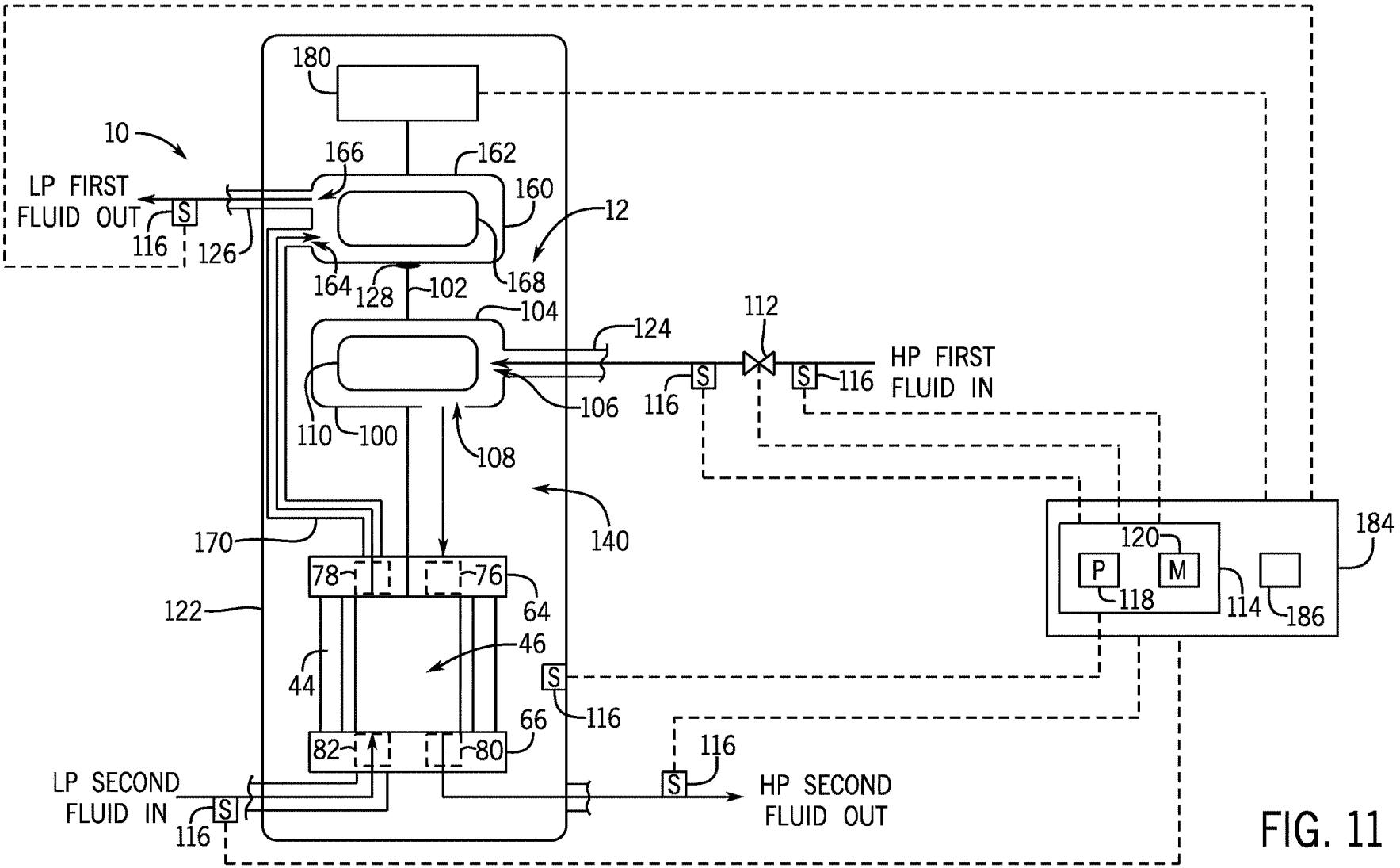
FIG. 11 is a cross-sectional view of an embodiment of a rotary IPX and with a hydraulic drive system that includes a first hydraulic drive device, a second hydraulic drive device, and a motor.

FIG. 11 is a cross-sectional view of an embodiment of the rotary IPX 10 and the hydraulic drive system 12 that includes the first hydraulic drive device 100, the second hydraulic drive device 160, and a motor 180 coupled to the shaft 102. For example, the motor 180 may be an electric motor. As illustrated, the motor 180 may be disposed in the casing 122 of the rotary IPX 10 with the first and second hydraulic drive devices 100 and 160. In some embodiments, the motor 180 may be external to the casing 122 of the rotary IPX 10. The shaft 102 may include the shaft seal 128 proximate to the second hydraulic drive device 160, as described in detail above, to minimize fluid leakage into the second hydraulic drive device 160. Additionally, a second shaft seal 182 may be disposed along the shaft 102 proximate to the motor 180 to minimize fluid leakage into and/or out of the motor 180.

In some embodiments, the motor 180 may include a dielectric fluid, such as one or more oils (e.g., mineral oil, castor oil, silicone oil, synthetic oil, etc.) and/or water (e.g., purified water, deionized water, distilled water, etc.). In some embodiments, the dielectric fluid may be at high pressure. For example, the pressure of the dielectric fluid may be approximately 5,000 kPa to 25,000 kPa, 20,000 kPa to 50,000 kPa, 40,000 kPa to 75,000 kPa, 75,000 kPa to 100,000 kPa. In some embodiments, the pressure of the dielectric fluid may be substantially the same as the pressure of the high pressure first fluid and/or the high pressure second fluid. For example, the pressure of the dielectric fluid may be within approximately 10%, 9%, 8%, 7%, 6%, 5%, 4%, 3%, 2%, 1%, or less of the pressure of the high pressure first fluid and/or the high pressure second fluid. This may be desirable to minimize the pressure differential on the second shaft seal 182.

The motor 180 may be used to drive rotation of at least the shaft 102 and the rotor 46. Additionally, in some embodiments, the motor 180 may be used to drive rotation of the first and the second hydraulic drive devices 100 and 160. That is, in some embodiments, the motor 180 may set the rotational speed of the shaft 102, the rotor 46, the first hydraulic drive device 100, and the second hydraulic drive device 160. As such, the first and second hydraulic drive devices 100 and 160 may both operate as hydraulic pumps and in particular, may displace or pump fluid at a flow rate that is substantially proportional to the rotational speed set by the motor 180. In some embodiments, the first hydraulic drive device 100 and/or the second hydraulic drive device 160 may operate as a hydraulic turbine or a hydraulic motor, and the motor 180 may be configured to supplement rotation of the rotor 46. In some embodiments 180 the motor 180 may be used to periodically supplement rotation of the rotor 46. For example, the motor 180 may supplement rotation of the rotor 46 to maintain a desired rotational speed while the rotary IPX 10 receives a highly viscous/particulate laden fluid. Further, in some embodiments, the motor 180 may be a motor-generator. For example, the first hydraulic drive device 100 may operate as a hydraulic turbine or motor, as described in detail above, to rotate the shaft 102 and the rotor 46, and the motor 180 may extract and store energy from rotation of the shaft 102. The motor 180 may use the stored energy to supplement rotation of the rotor 46 as needed (e.g., if rotational speed slows due to a large solid in the rotary IPX 10).

The motor 180 may also be coupled to a control system 184, which may be external to the casing 122 of the rotary IPX 10. The control system 184 may include a power source 186 configured to provide electrical power to the motor 180. For example, the power source 186 may include an alternating current (AC) source, a direct current (DC) source, a battery, etc. In some embodiments, the control system 184 may include the controller 114 or any other suitable processor-based device to control the motor 180 and/or the flow of power from the power source 186 to the motor 180. For example, in some embodiments, the controller 114 may use feedback from the one or more sensors 116 to determine the rotational speed of the shaft 102 and may use the determined rotational speed to control power output of the motor 180.

The motor 180 may be used to drive rotation of the shaft 102 and the rotor 46. Additionally, in some embodiments, the motor 180 may be used to drive rotation of the first and the second hydraulic drive devices 100 and 160. That is, in some embodiments, the motor 180 may set the rotational speed of the shaft 102, the rotor 46, the first hydraulic drive device 100, and the second hydraulic drive device 160. As such, the first and second hydraulic drive devices 100 and 160 may both operate as hydraulic pumps and in particular, may displace or pump fluid at a flow rate that is based on or substantially proportional to the rotational speed set by the motor 180.

As described detail above, a fluid handling system may include a rotary isobaric pressure exchanger (IPX) to exchange pressures between first and second fluids. For example, the rotary IPX may receive a high pressure first fluid (e.g., a non-corrosive, non-abrasive, and/or particulate-free fluid) and a low pressure second fluid (e.g., a corrosive, abrasive, and/or particulate-laden fluid) and may exchange pressures between the high pressure first fluid and the low pressure second fluid to output the second fluid at high pressure. The fluid handling system also includes a hydraulic drive system coupled to a rotor of the rotary IPX via a shaft. The hydraulic drive system is configured to drive rotation of the rotor at a desired rotational speed to reduce or minimize inefficiencies of the rotary IPX and to reduce or minimize fluid mixing of the first and second fluids (e.g., in the fluid interface that is disposed in the channels of the rotor and/or in the output streams of the rotary IPX). Thus, the hydraulic drive system may increase the performance of the rotary IPX.

Further, as described in detail above, the hydraulic drive system may include at least one hydraulic drive device (e.g., a hydraulic turbine, a hydraulic motor, and/or a positive displacement device) coupled to the shaft. The hydraulic drive device may use hydraulic energy of a received fluid to rotate the shaft and the rotor at a rotational speed that varies with, is based on, or is substantially directly proportional to the flow rate of the received fluid. In some embodiments, the high pressure first fluid may be routed through the hydraulic drive device before the high pressure first fluid enters the rotor. Thus, the high pressure first fluid may be used to drive rotation of the rotor, and the rotational speed of the rotor may be based on or substantially directly proportional to the flow rate of the high pressure first fluid. As such, the hydraulic drive system may establish or control a relationship (e.g., a nonlinear relationship or a substantially linear or fixed relationship) between the flow rate of the high pressure first fluid and the rotational speed of the rotor, which may reduce or minimize inefficiencies of the rotary IPX and may reduce or minimize fluid mixing of the first and second fluids. Additionally, in some embodiments, the hydraulic drive system may include a second hydraulic drive device coupled to the same shaft as the first hydraulic drive device and the rotor. The second hydraulic drive device may receive low pressure fluid of the rotary IPX (e.g., low pressure first fluid or low pressure second fluid) and may be configured to intake the low pressure fluid at a flow rate that is based on, substantially directly proportional to, or the same as the flow rate of the high pressure first fluid entering the first hydraulic drive device and that is based on or substantially directly proportional to the rotational speed of the rotor. Thus, the hydraulic drive system may establish or control a relationship (e.g., a nonlinear relationship or a substantially linear or fixed relationship) between the flow rates of the first and second fluids entering the rotor and the rotational speed of the rotor, which may reduce or minimize inefficiencies of the rotary IPX and may reduce or minimize fluid mixing of the first and second fluids.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a rotary isobaric pressure exchanger (IPX) configured to exchange pressures between a first fluid and a second fluid, wherein the rotary IPX comprises a rotor;

a hydraulic drive system comprising a first hydraulic drive device coupled to the rotor, wherein the first hydraulic drive device is configured to receive a hydraulic fluid and to convert hydraulic energy of the hydraulic fluid into mechanical energy to rotate the rotor at a rotational speed that is based on a flow rate of the hydraulic fluid entering the first hydraulic drive device; and a mixing chamber configured to receive the hydraulic fluid discharged from the first hydraulic drive device and to receive the first fluid, wherein the hydraulic fluid and the first fluid are configured to mix within the mixing chamber to form a fluid mixture, and wherein the rotary IPX is configured to receive the fluid mixture from the mixing chamber and to exchange pressures between the fluid mixture and the second fluid.

2. The system of claim 1, wherein the first hydraulic drive device is configured to establish a substantially linear relationship between the flow rate of the hydraulic fluid entering the first hydraulic drive device and the rotational speed of the rotor.

3. The system of claim 1, wherein the first hydraulic drive device is configured to establish a nonlinear relationship between the flow rate of the hydraulic fluid entering the first hydraulic drive device and the rotational speed of the rotor.

4. The system of claim 1, wherein the rotary IPX is configured to:

receive the first fluid at high pressure and the second fluid at low pressure; and output the first fluid at low pressure and the second fluid at high pressure after exchanging pressures between the first fluid and the second fluid; and wherein the hydraulic fluid received by the first hydraulic drive device is the first fluid, and wherein the rotary IPX is configured to receive the first fluid at high pressure from the first hydraulic drive device.

5. The system of claim 4, wherein the hydraulic drive system comprises a second hydraulic drive device coupled to the first hydraulic drive device and the rotor, wherein the second hydraulic drive device is configured to receive the first fluid at low pressure from the rotary IPX and to displace the first fluid at a second flow rate that is based on the rotational speed of the rotor and the flow rate of the first fluid entering the first hydraulic drive device.

6. The system of claim 5, wherein the second flow rate of the first fluid displaced by the second hydraulic drive device is substantially directly proportional to the rotational speed of the rotor and the flow rate of the hydraulic fluid entering the first hydraulic drive device.

7. The system of claim 1, wherein the first hydraulic drive device comprises a hydraulic motor.

8. A system, comprising:

a rotary isobaric pressure exchanger (IPX) configured to exchange pressures between a first fluid and a second fluid, wherein the rotary IPX comprises a rotor and a shaft coupled to the rotor;

a hydraulic drive system comprising a first hydraulic drive device coupled to the rotor via the shaft, wherein the first hydraulic drive device is configured to receive a hydraulic fluid and to convert hydraulic energy of the hydraulic fluid into mechanical energy to rotate the shaft and the rotor at a rotational speed that is based on a flow rate of the hydraulic fluid entering the first hydraulic drive device; and a mixing chamber configured to receive the hydraulic fluid discharged from the first hydraulic drive device and to receive the first fluid, wherein the hydraulic fluid and the first fluid are configured to mix within the mixing chamber to form a fluid mixture, and wherein the rotary IPX is configured to receive the fluid mixture from the mixing chamber and to exchange pressures between the fluid mixture and the second fluid.

9. The system of claim 8, wherein the first hydraulic drive device comprises a positive displacement device configured to establish a substantially linear relationship between the flow rate of the hydraulic fluid entering the positive displacement device and the rotational speed of the rotor.

10. The system of claim 8, wherein the hydraulic fluid comprises the first fluid, and wherein the rotary IPX is configured to receive the first fluid at high pressure from the first hydraulic drive device.

11. The system of claim 10, wherein the hydraulic drive system comprises a second hydraulic drive device coupled to the first hydraulic drive device and the rotor via the shaft, wherein the second hydraulic drive device is configured to receive the first fluid at low pressure from the rotary IPX and to displace the first fluid at a second flow rate that is substantially directly proportional to the rotational speed of the rotor and the flow rate of the first fluid entering the first hydraulic drive device.

12. The system of claim 11, wherein the hydraulic drive system comprises an electric motor coupled to the shaft.

13. A system, comprising:

a casing;

a rotary isobaric pressure exchanger (IPX) disposed in the casing, wherein the rotary IPX is configured to exchange pressures between a first fluid and a second fluid, wherein the rotary IPX comprises a rotor and a shaft coupled to the rotor;

a hydraulic drive system comprising a first hydraulic drive device coupled to the rotor via the shaft, wherein the first hydraulic drive device comprises:

a housing;

a first inlet port through the housing and configured to receive a hydraulic fluid;

a first outlet port through the housing and configured to output the hydraulic fluid; and a rotating or reciprocating component disposed in the housing, wherein the rotating or reciprocating component is configured to convert hydraulic energy of the hydraulic fluid into mechanical energy to rotate the shaft and the rotor at a rotational speed that is based on a flow rate of the hydraulic fluid entering the first inlet port of the first hydraulic drive device, wherein the housing and the first outlet port of the first hydraulic drive device are disposed in the casing, and wherein the first inlet port of the first hydraulic drive device extends through the casing; and a mixing chamber disposed in the casing, wherein the mixing chamber is configured to receive the hydraulic fluid from the first outlet port of the first hydraulic drive device and to receive the first fluid from a second inlet port through the casing, wherein the hydraulic fluid and the first fluid are configured to mix within the mixing chamber to form a fluid mixture, and wherein the rotary IPX is configured to receive the fluid mixture from the mixing chamber and to exchange pressures between the fluid mixture and the second fluid.

14. The system of claim 13, wherein the housing of the first hydraulic drive device is disposed in the casing, and wherein the first inlet port and the first outlet port of the first hydraulic drive device extend through the casing.

15. The system of claim 14, wherein the hydraulic fluid comprises a dielectric fluid.

16. The system of claim 13, wherein the hydraulic fluid comprises the first fluid, and wherein the rotary IPX is configured to receive the first fluid at high pressure from the first outlet port of the first hydraulic drive device and to receive the second fluid at low pressure from a second inlet port through the casing, and wherein the rotary IPX is configured to output the first fluid at low pressure and the second fluid at high pressure after exchanging pressures between the first fluid and the second fluid.

17. The system of claim 16, wherein the hydraulic drive system comprises a second hydraulic drive device disposed in the casing and coupled to the shaft, wherein the second hydraulic drive device is configured to receive the first fluid at low pressure from the rotary IPX and to displace the first fluid at a second flow rate that is substantially directly proportional to the rotational speed of the rotor and the flow rate of the first fluid entering the first hydraulic drive device.

* * * * *